US008578516B2

(12) United States Patent
Li

(10) Patent No.: US 8,578,516 B2
(45) **Date of Patent: *Nov. 12, 2013**

(54) INSULATING PRODUCT AND METHOD

(76) Inventor: Yick Lap Li, Tseung Kwan O (HK)

( * ) Notice: Subject to any disclaimer, the term of this patent is extended or adjusted under 35 U.S.C. 154(b) by 266 days.

This patent is subject to a terminal disclaimer.

(21) Appl. No.: 12/982,253

(22) Filed: Dec. 30, 2010

(65) Prior Publication Data

US 2011/0094004 A1 Apr. 28, 2011

Related U.S. Application Data

(63) Continuation-in-part of application No. 12/182,655, filed on Jul. 30, 2008, now abandoned.

(51) Int. Cl.
*A41D 3/02* (2006.01)
*A47G 9/00* (2006.01)

(52) U.S. Cl.
USPC ..... 2/97; 5/413 R; 5/950

(58) Field of Classification Search
USPC ..... 2/97; 5/413 R, 502, 950, 952; 112/420, 112/440, 422, 423, 428
See application file for complete search history.

(56) References Cited

U.S. PATENT DOCUMENTS

| | | | | | |
|---|---|---|---|---|---|
| 1,123,345 | A | * | 1/1915 | Micon | 5/690 |
| 1,345,046 | A | * | 6/1920 | Wedlock | 112/417 |
| 1,893,548 | A | * | 1/1933 | Hardy | 5/502 |
| 2,179,424 | A | * | 11/1939 | Phillips et al. | 5/413 R |
| 2,464,380 | A | * | 3/1949 | Daiber | 2/458 |
| 2,725,927 | A | * | 12/1955 | Jack Feinerman | 112/427 |
| 2,730,721 | A | * | 1/1956 | Van Veen | 5/413 R |
| 2,831,198 | A | * | 4/1958 | Datlof | 2/458 |
| 2,878,481 | A | * | 3/1959 | Siminow | 112/400 |
| 3,639,931 | A | * | 2/1972 | McGuire | 5/413 R |
| 3,805,720 | A | * | 4/1974 | Hunt | 112/420 |
| 3,878,574 | A | * | 4/1975 | Erickson | 5/413 R |
| 3,959,834 | A | * | 6/1976 | Hunt | 5/413 R |
| 3,988,791 | A | * | 11/1976 | Simon | 5/413 R |
| 4,090,269 | A | * | 5/1978 | Hunt | 5/413 R |
| 4,115,610 | A | * | 9/1978 | Wortman | 428/102 |
| 4,354,281 | A | * | 10/1982 | Satoh | 5/413 R |
| 4,426,945 | A | * | 1/1984 | A-Yan | 112/475.08 |
| 4,896,387 | A | * | 1/1990 | Malcolm et al. | 5/413 R |
| 5,199,121 | A | * | 4/1993 | Payne | 5/502 |
| 5,459,895 | A | * | 10/1995 | Kikuchi et al. | 5/502 |
| 5,483,713 | A | * | 1/1996 | Kikuchi et al. | 5/502 |
| 5,713,079 | A | * | 2/1998 | Simon et al. | 2/243.1 |
| 5,799,600 | A | * | 9/1998 | Reuben | 112/420 |
| 5,987,669 | A | * | 11/1999 | Leggett et al. | 5/502 |
| 6,301,730 | B1 | * | 10/2001 | Delfs et al. | 5/502 |
| 6,754,918 | B1 | * | 6/2004 | Lap | 5/413 R |
| 7,045,191 | B2 | * | 5/2006 | Huntley | 428/137 |
| 7,094,714 | B2 | * | 8/2006 | Lap et al. | 442/1 |
| 7,467,429 | B2 | * | 12/2008 | Soreano | 5/502 |
| 7,818,834 | B2 | * | 10/2010 | Li | 5/413 R |
| 8,057,878 | B2 | * | 11/2011 | Lo et al. | 428/116 |
| 2003/0182708 | A1 | * | 10/2003 | Gathings, Jr. | 2/97 |
| 2006/0046024 | A1 | * | 3/2006 | Huntley | 428/137 |
| 2007/0294800 | A1 | * | 12/2007 | Huang | 2/97 |
| 2010/0024701 | A1 | * | 2/2010 | Li | 112/420 |
| 2010/0107333 | A1 | * | 5/2010 | Ortlieb | 5/413 R |
| 2011/0047699 | A1 | * | 3/2011 | Regan et al. | 5/502 |

* cited by examiner

*Primary Examiner* — Alissa L Hoey
(74) *Attorney, Agent, or Firm* — Donald J. Ranft; Collen IP

(57) ABSTRACT

An insulating product and method for its creation involving inner valves designed to impede the flow of insulating materials between compartments formed by the inner valves. This allows for creating vertical baffles in addition to the typical horizontal baffles.

12 Claims, 9 Drawing Sheets

FIGURE 1 - PRIOR ART
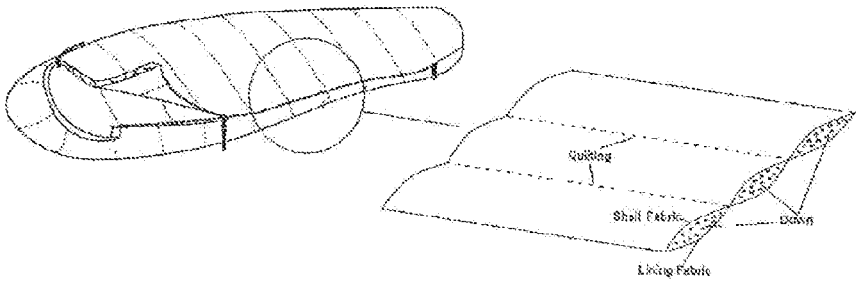
FIGURE 2 - PRIOR ART
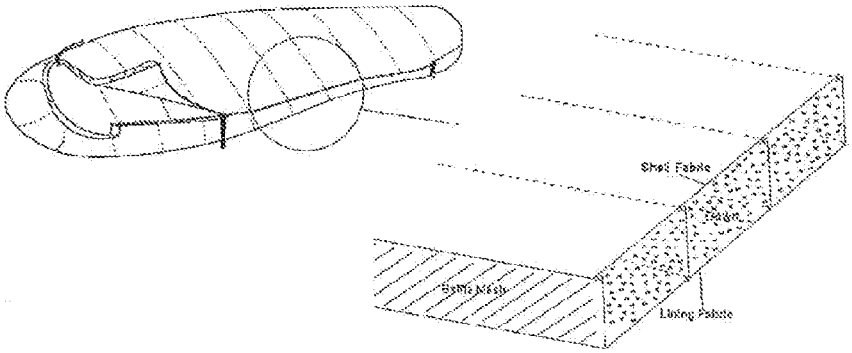

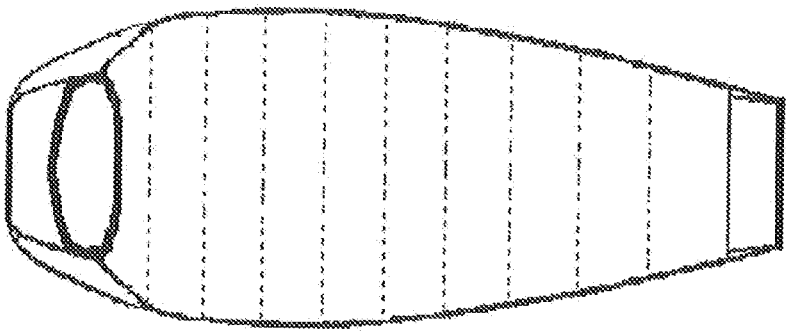
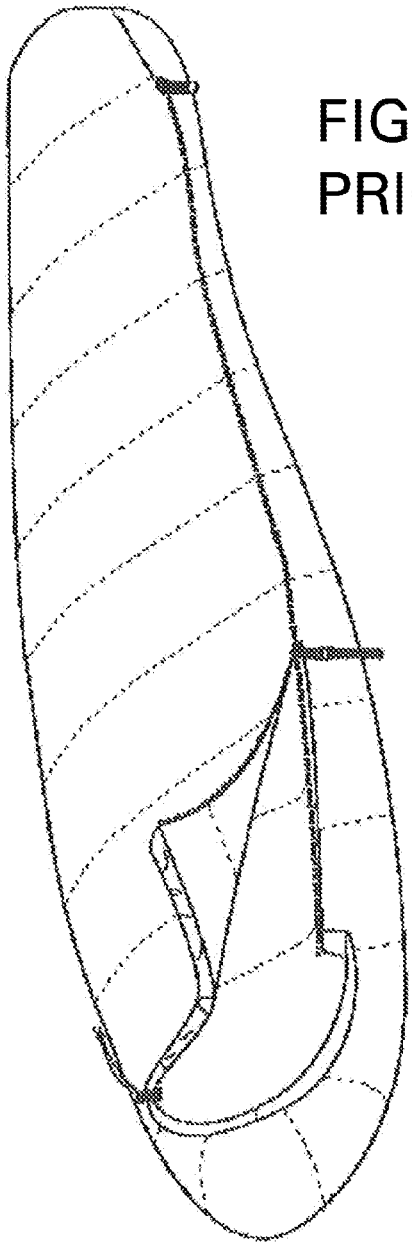
FIG 3 - PRIOR ART

FIGURE 4 - PRIOR ART
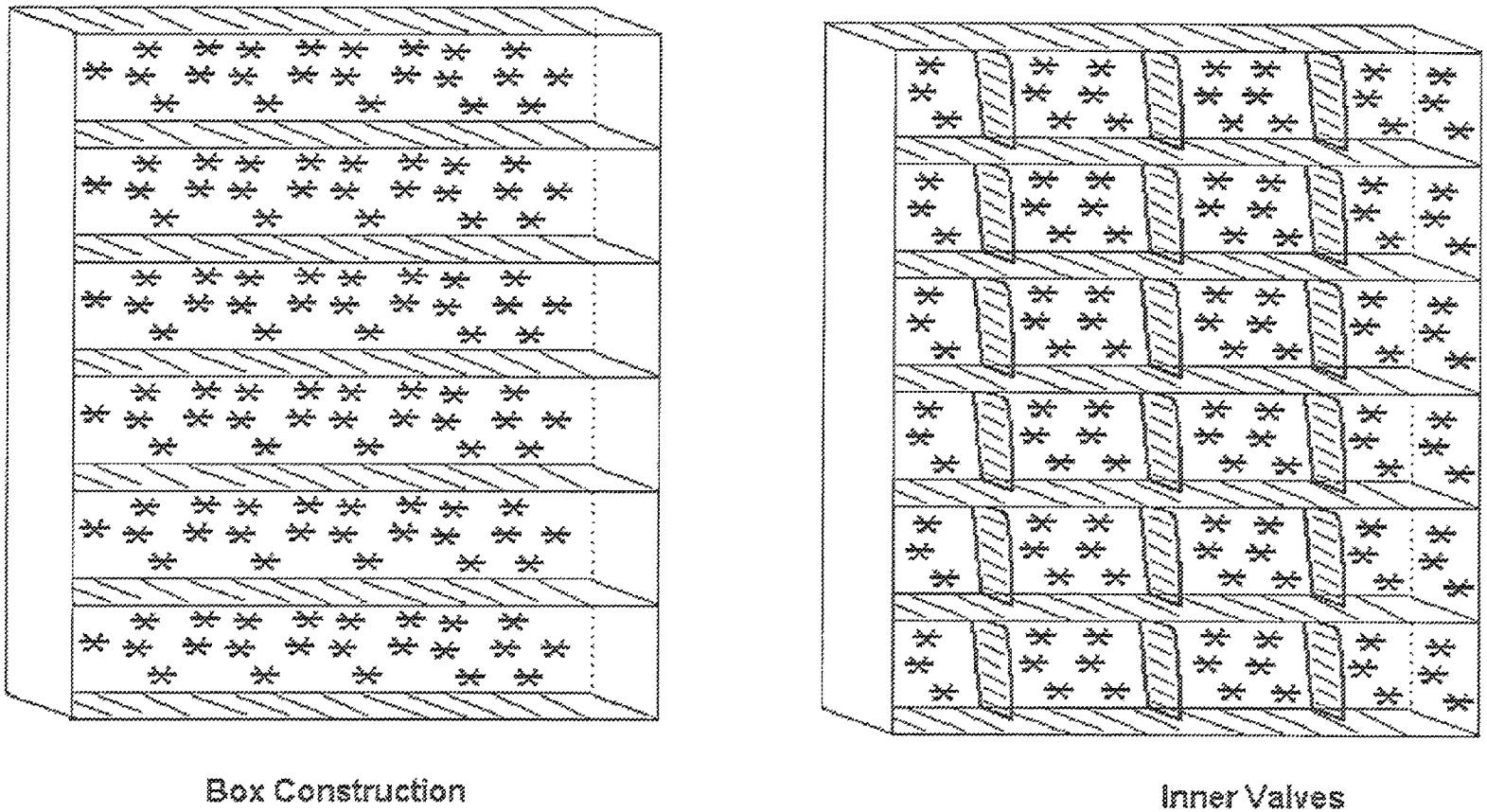

FIGURE 5
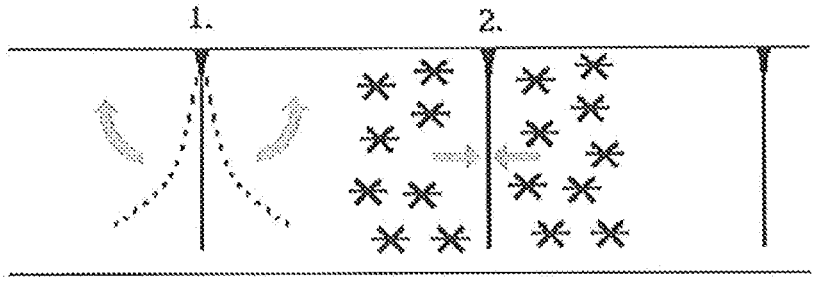
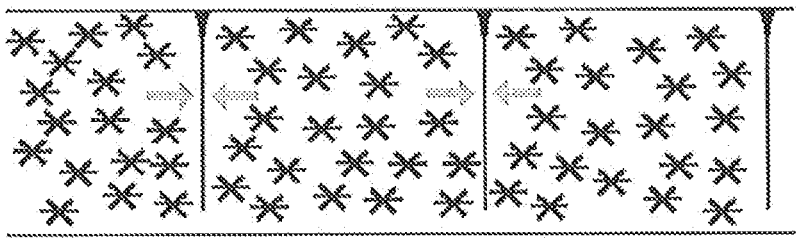
FIGURE 6

INSULATING PRODUCT AND METHOD

This Application is a Continuation-in-Part Application of application Ser. No. 12/182,655 filed Jul. 30, 2008.

BACKGROUND OF INVENTION

Down Feather insulated sleeping bags are very commonly found in the marketplace today. Although different products from different brands may give different looks to the product, the basic construction technique remains for more than 20 years. The basic idea behind any down construction technique is to create a compartment of space, to fill it with down content and to close the fill hole.

Down, as an insulation material, behaves like a fluid in which it will shift to area with lower density. So the key in designing a down sleeping bag is to attain a fine balance between filling weight (amount of down) and the volume of space. Because of this limitation, most of the products we find in the marketplace, although with different colors and aesthetic, basically share the same common construction atomony. Below are the two commonly used down construction techniques:

Sewn-Through Construction (FIG. 1)—This is a very simple form of construction which is very commonly found in lighter weight/lower end product. The basic construction is very simple: stitching together two pieces of fabrics together creates compartment "tunnel", which one will fill the "tunnel" with down feather content. The drawback with this construction is that there is no down coverage along each stitch line (generally call "cold spots"), and thus giving an uneven thermal performance. As a result, this construction technique is only found in lighter weight/lower end product where thermal performance is not very critical.

Baffle Construction (FIG. 2)—This construction is widely used in most down product today. The idea is very similar to Sewn-Through construction and the only difference is the addition of a partition material called "baffle mesh". The baffle mesh sits between the two fabrics and provides a "height" factor to the down compartment. As a result, the cold spots are eliminated in the process and thus offering a more even thermal experience to the user.

The idea behind the above two constructions is to create a "hollow tube" for which the down will fill up the volume inside. The challenge is the bigger the volume, the more free space available and thus the higher chance of down shifting. Down shifting basically refers to the fact that the down overshift from one side to the other, creating an imbalance coverage and thus affecting a consistent thermal performance. In order to avoid down shifting, it is important to limit the size/volume of each baffle compartment which results in very common finding in almost all down sleeping bag in the market today: horizontal baffling. Regardless of sizes, weight, constructions, brands, essentially all down sleeping bags are with horizontal baffling (FIG. 3).

SUMMARY

This invention adds inner valves in the baffles to create compartments restricting the movement of insulating material such as down. This new construction offers more flexibility on the design, aesthetic appearance and thermal performance of the insulated product.

The introduction of inner valves construction offers a number of advantages over existing construction techniques:

1. It provides much better flexibility in down sleeping bag design (design freedom).
2. By allowing the baffles to be vertical, it reduces the use of baffle mesh and thus reduce the product total weight. (FIG. 7)
3. Provides more comfortable user experience. The vertical baffling goes along with the body contour whereas the traditional down sleeping bag with horizontal baffling goes against it. User will feel more natural and fit inside and thus a more comfortable experience.

DESCRIPTION OF DRAWINGS

FIG. 1 depicts a typical existing sewn-through construction.

FIG. 2 depicts a typical existing baffle construction.

FIG. 3 depicts a typical existing horizontal baffling.

FIG. 4 depicts an existing baffle construction and said construction with inner valves added.

FIG. 5 depicts a partial cross section of partially down filled compartments separated by inner valves.

FIG. 6 depicts a partial cross section of down filled compartments separated by inner valves.

DETAILED DESCRIPTION

This invention builds upon the current Baffle Construction by adding inner valves acting as a trapdoor inside each of the baffle compartments. Although down behaves similarly to fluid, it moves at a much slower pace as down feathers tend to tangle up with each other. The installment of the inner valves is not to confine the down but rather to provide enough of an obstruction to limit the down's movement.

By taking advantage of the inner valve construction, one can design a down sleeping bag without the restriction of limiting baffle volume. One of the most obvious improvements is the possibility of creating a down sleeping bag with vertical baffling. Under the current constructions technique available, a typical vertical baffle compartment will be between 60" to 70" long, which will have serious down shifting problems. The possible problem with this setup is that, if the down shifts heavily towards one end over the other, there will be a serious imbalance of thermal performance. With the inner valve construction, the "trapdoors" prevent the down from moving freely within the baffle volume. The concept behind the inner valves is not to completely isolate the down from each other, but limit movement of the down by having the down behind each side of the valves pushing each other. By filling each compartment with down, the resulting pressure on each side of the inner valves essentially prevents movement of the inner valve and the down. (FIGS. 4, 5 and 6).

Figure 7:
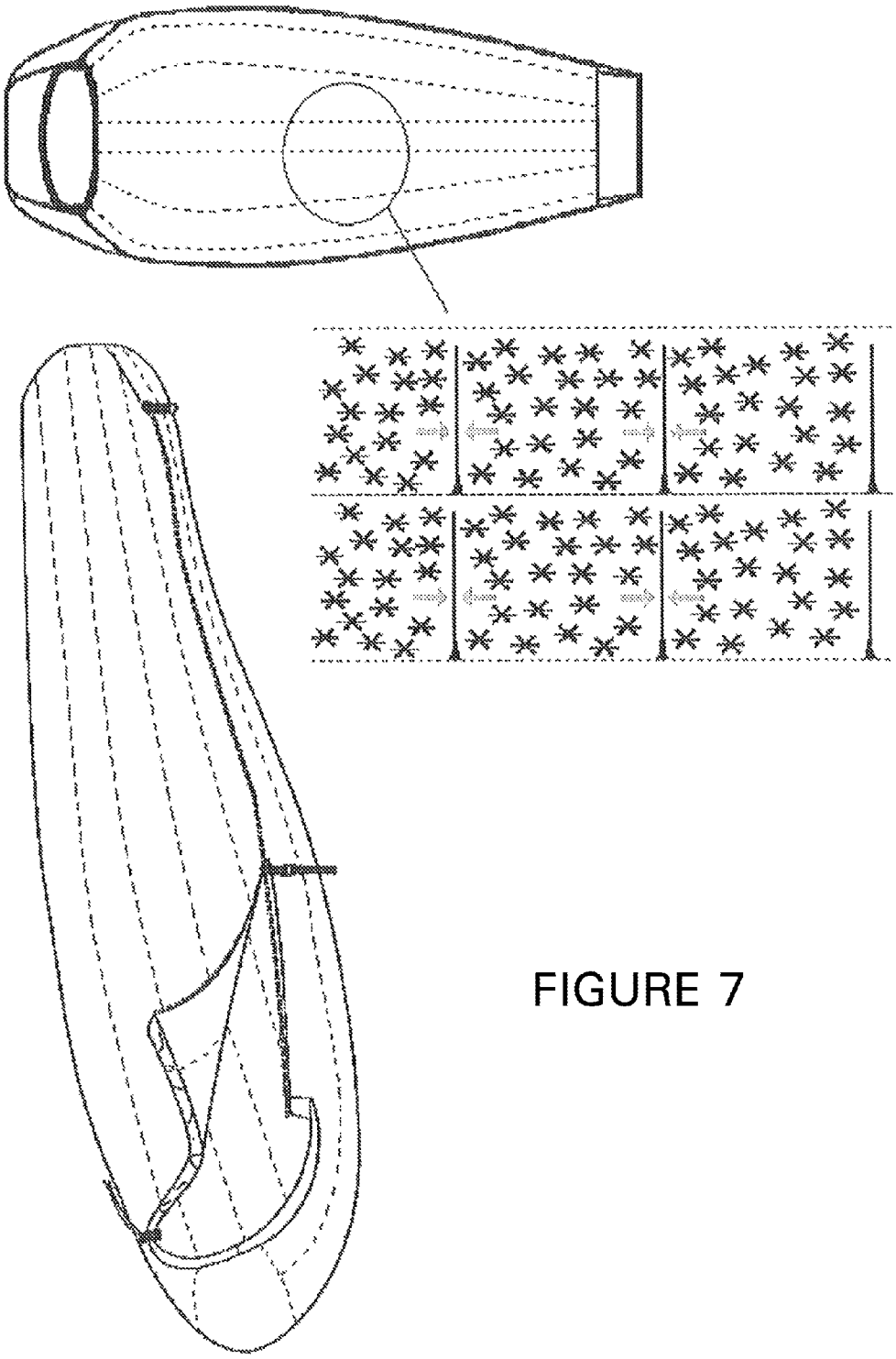
FIG. 7 illustrates a sleeping bag utilizing vertical baffles and a partial top view depicting down filled compartments separated by inner valves.
Figure 8:
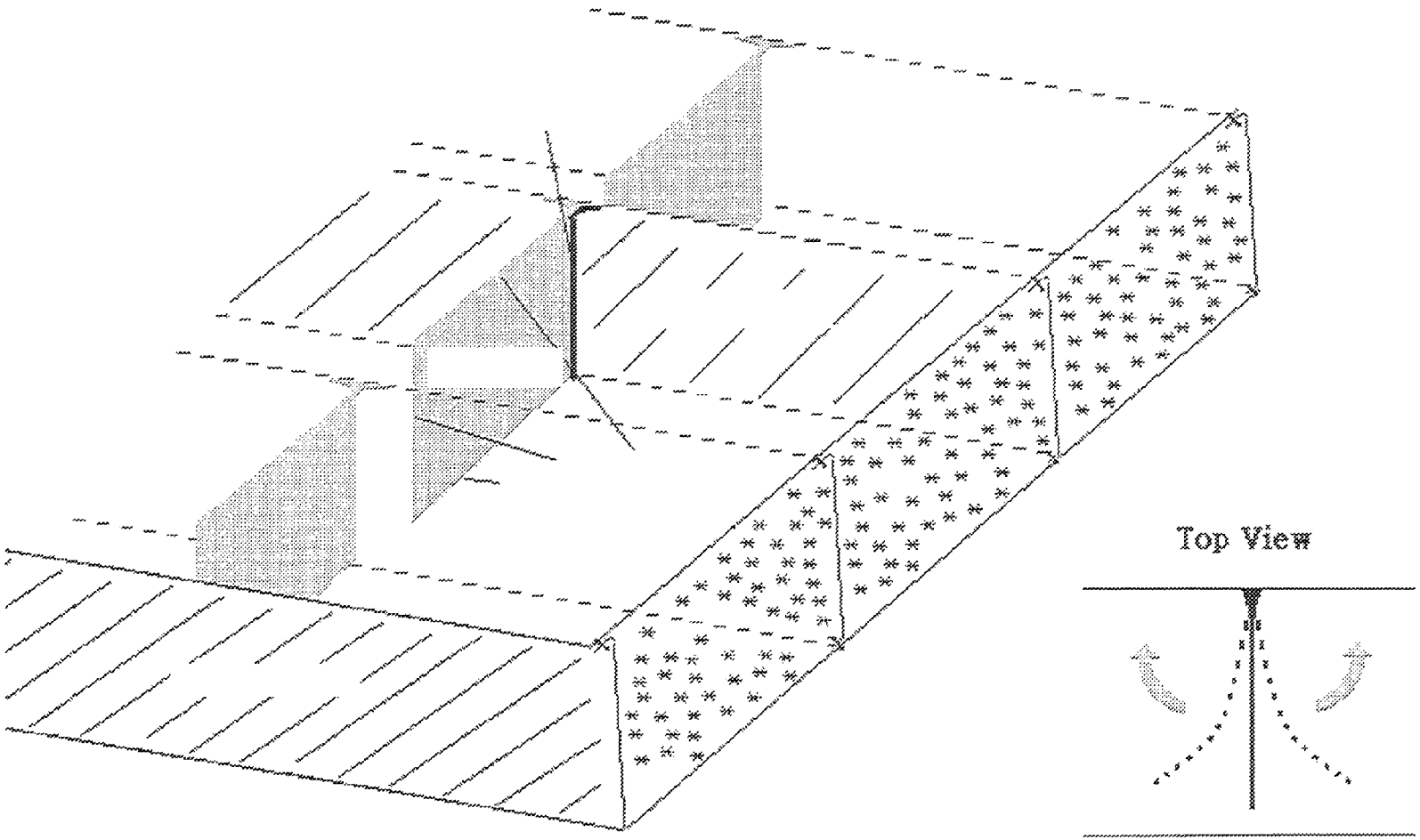
FIG. 8 depicts a perspective sectional view of compartments created by inner valves and a top view of one inner valve.

As seen on FIG. 8, the inner valves are affixed at one end only to baffle mesh on either horizontal or vertical baffles. By not attaching to the shell fabric, lining fabric, nor another baffle mesh, the inner valve is allowed to serve its trapdoor function. And since it is not attached to either the shell or lining fabric, the inner valve is not visible externally.

The inner valves can be constructed of fabric or netting such as commonly used for the baffle mesh. The inner valves can be folded in half as shown as C on FIG. 9 to increase the resistance to movement. In addition the inner valves can be twisted before being attached. (A & B on FIG. 9).

The space between two adjacent baffle meshes creates baffles which are typically in the form of a box as shown on the Figures. The baffle mesh is joined to the inner lining or outer shell at the corners of the baffle boxes. In other embodiments two opposite ends of the inner valves are attached at the corners of the baffle boxes in lieu of the attachment to the baffle mesh. As shown on FIG. 9 the corners of a typical baffle box construction can be identified as 1, 2, 3 & 4. The inner valves can be attached to any two of these corners such as 1 & 2 or 2 & 4 as shown as A and B on FIG. 9.

Figure 9:
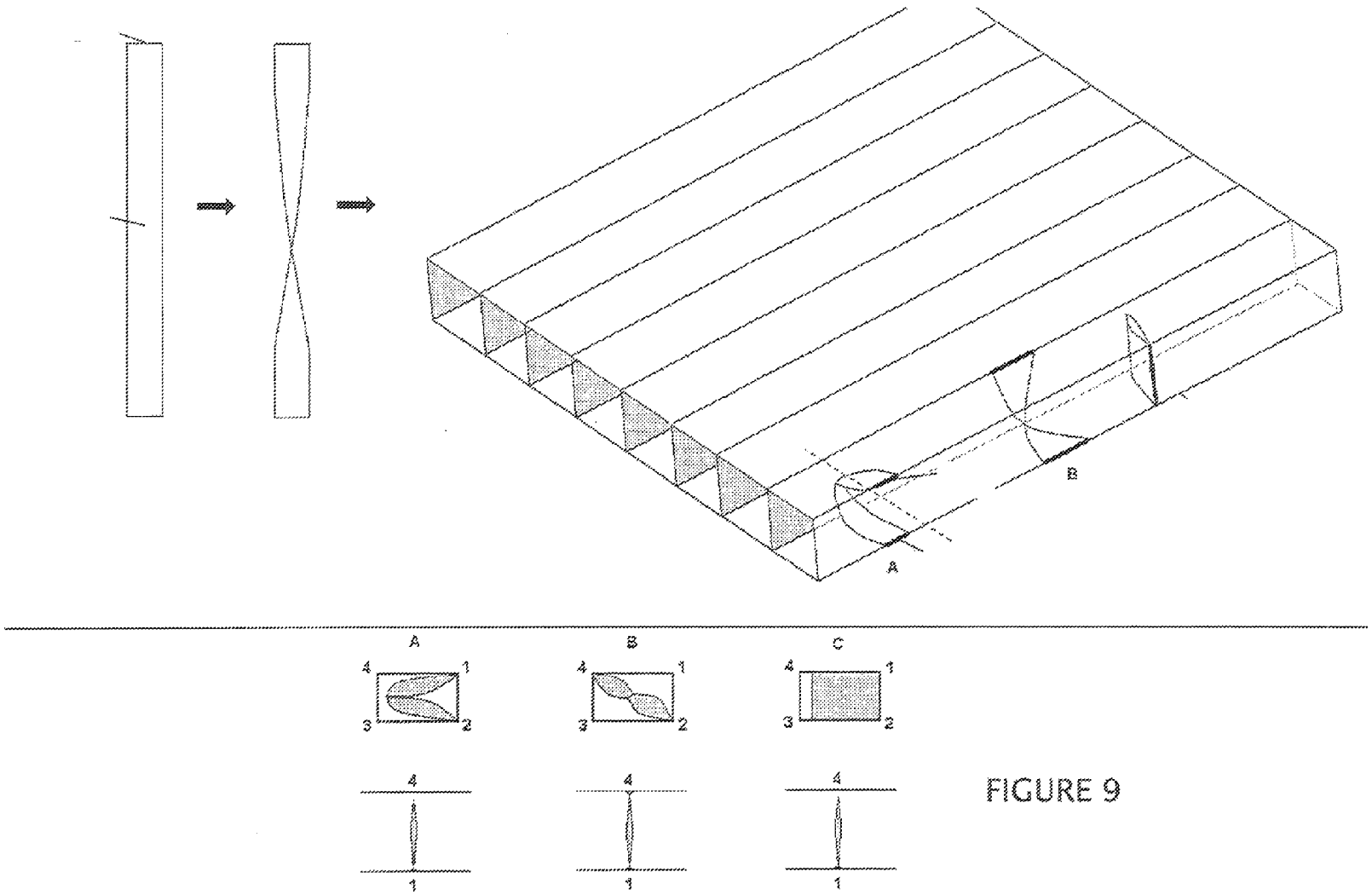
FIG. 9 depicts other embodiments of the inner valves and their attachment at corners of baffle box.

In another embodiment the inner valves are folded essentially in half to increase its resistance to movement (embodiment C on FIG. 9).

Figure 10:
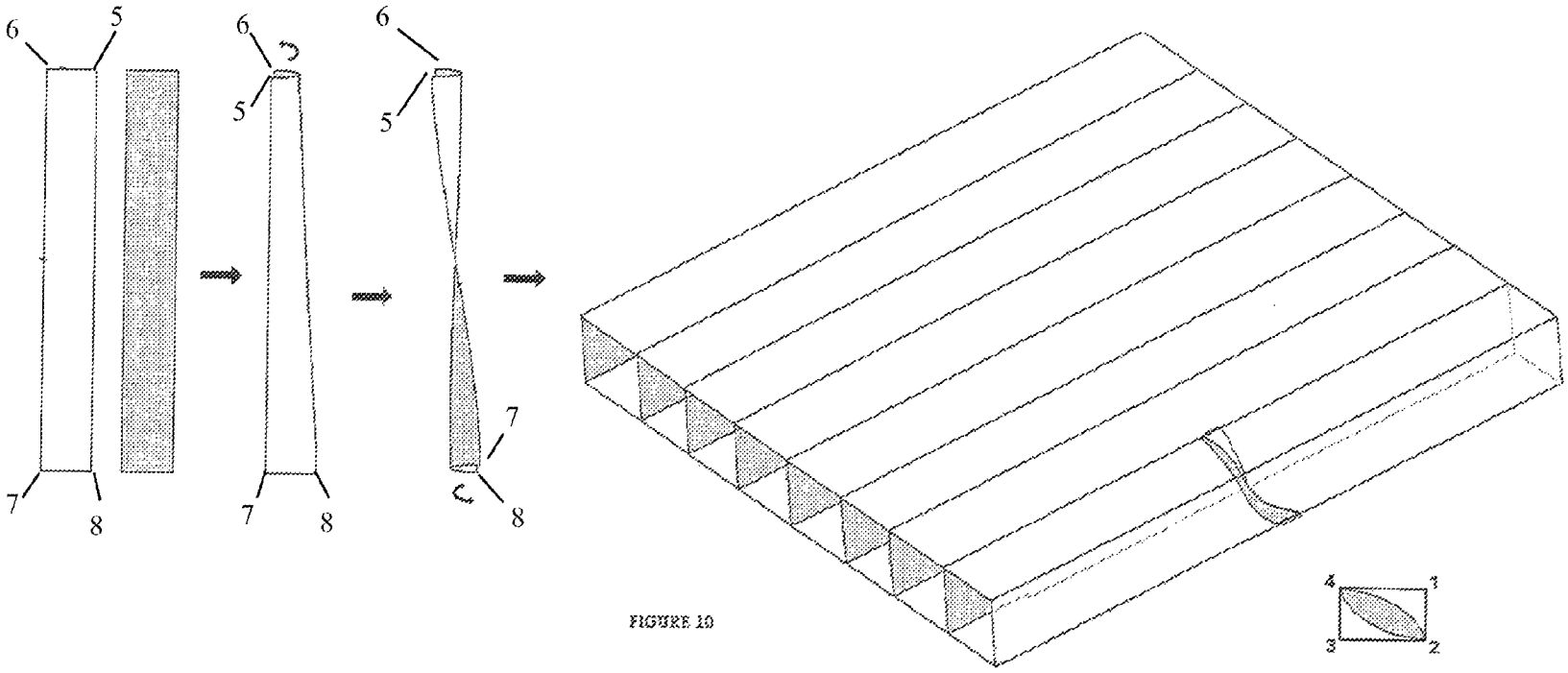
FIG. 10 depicts another embodiment of the inner valves configuration and their attachment at corners of baffle box.
Figure 11:
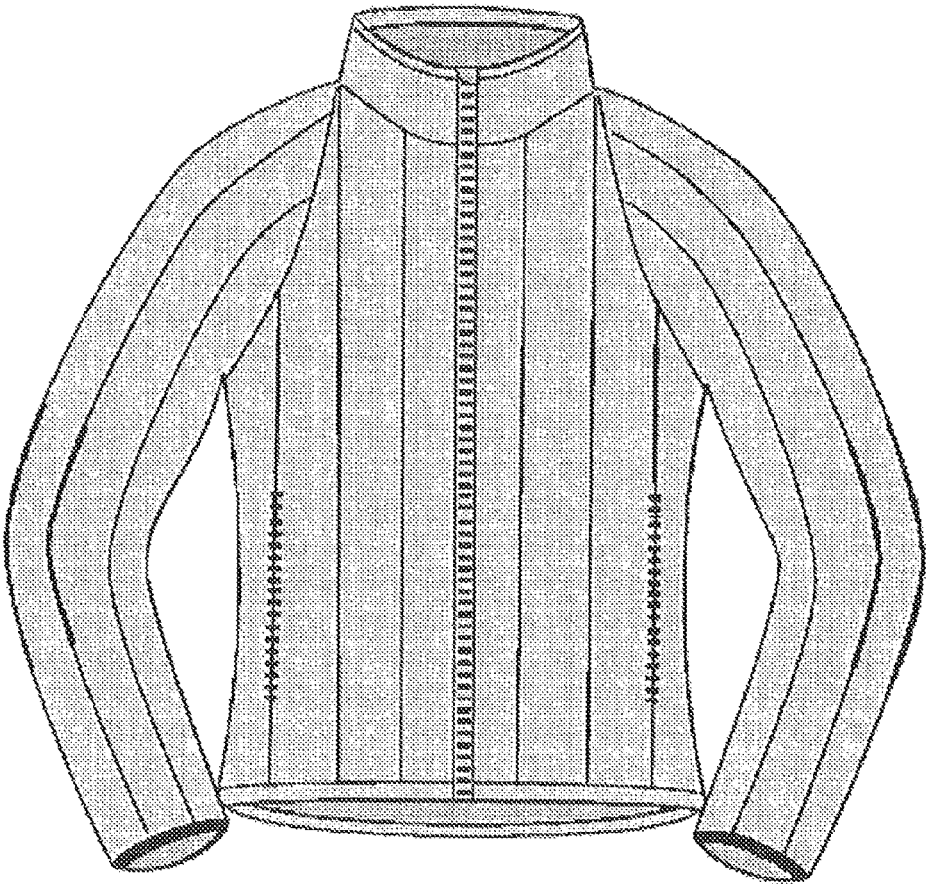
FIG. 11 depicts another embodiment of the inner valves used in clothing.

In another embodiment the inner valves are folded/twisted in a manner which creates additional surface area in the baffle to block the flow of insulating material depicted in FIG. 10. Edge 5 is folded in one direction and edge 6 is folded in the opposite direction. For example with the inner valve laying flat the right corner of the top edge (5) is folded over to meet the left corner of the top edge (6). And the left corner of the bottom edge (7) is folded over to meet the right corner of the bottom edge (8). The joined corners of the top edge and the joined corners of the bottom edge are then attached to two of the four corners in the baffles.

The above described invention can be used in the construction of sleeping bags, clothing, blankets and other applications requiring insulation such as piping, buildings, housing, structures, etc. Its use is not limited to down insulation but can be used with synthetic fibers or any other insulating material desired to be used in a particular application. The type of material used and the method of attachment for the inner valves can also be varied depending on the particular application intended for the insulated product. It is recognized that departures from the disclosed embodiments may be made within the scope of this invention and that obvious modification will occur to a person skilled in the art.

I claim:

1. An insulated product comprising:

an outer shell; an inner lining;

a minimum of two baffle meshes attached in parallel to each other to the outer shell and inner lining extending from one end of the shell and lining to an opposite end creating baffles wherein the baffles created between two adjacent meshes are essentially rectangular shaped with four corners formed by the attachment of each mesh to the shell and lining;

a plurality of inner valves, each inner valve comprising a folded rectangular piece of material, a top right corner is folded over in one direction and joined to a top left corner and a lower left corner is folded over in another direction and joined to a lower right corner forming the inner valve with a folded and twisted shape, the joined top left and right corner of the inner valve is joined to one of the corners in the baffles and the joined lower right and left corner of the inner valve is joined to another one of the corners in the baffles;

an insulating material on each side of each inner valve; and the inner lining attached to the outer shell at the one end and the opposite end.

2. An insulating product according to claim 1 in which the insulating material is down.

3. An insulating product according to claim 1 in which the product is a sleeping bag.

4. An insulating product according to claim 1 in which the insulating product is clothing.

5. An insulating product according to claim 1 in which the baffles are created horizontally across the product.

6. An insulating product according to claim 1 in which the baffles are created vertically across the product.

7. A method for creating an insulating product comprising:

creating an outer shell;

creating an inner lining;

attaching one side of the outer shell to one side of the inner lining;

attaching a minimum of two baffle meshes from one side of the outer shell to an opposite side creating baffles wherein the baffles created between two adjacent meshes are essentially rectangular shaped with four corners formed by the attachment of each mesh to the shell and lining;

creating a plurality of inner valves with each inner valve comprising a folded rectangular piece of material;

folding a top right corner of each inner valve over in one direction and joining to a top left corner and folding a lower left corner of each inner valve in another direction and joining to a lower right corner, thereby forming a folded and twisted shape for each inner valve;

joining the joined top left and right corners of each inner valve to one of the corners in the baffles;

joining the joined lower right and left corners to another one of corners in the baffles attaching the inner lining to the baffle mesh;

adding insulating material to each side of each inner valve; and attaching the remaining side of the inner lining to the outer shell.

8. A method for creating an insulating product according to claim 7 in which the insulating material is down.

9. A method for creating an insulating product according to claim 7 in which the product is a sleeping bag.

10. A method for creating an insulating product according to claim 7 in which the insulating product is a garment or other clothing.

11. A method for creating an insulating product according to claim 7 in which the baffles are created horizontally across the product.

12. A method for creating an insulating product according to claim 7 in which the baffles are created vertically across the product.

* * * * *